US008912966B2

(12) United States Patent
Kerselaers

(10) Patent No.: US 8,912,966 B2
(45) Date of Patent: Dec. 16, 2014

(54) DUAL BAND SLOT ANTENNA

(75) Inventor: Anthony Kerselaers, Herselt (BE)

(73) Assignee: NXP, B.V., Eindhoven (NL)

( * ) Notice: Subject to any disclaimer, the term of this patent is extended or adjusted under 35 U.S.C. 154(b) by 796 days.

(21) Appl. No.: 12/738,764

(22) PCT Filed: Oct. 16, 2008

(86) PCT No.: PCT/IB2008/054257

§ 371 (c)(1),
(2), (4) Date: Apr. 19, 2010

(87) PCT Pub. No.: WO2009/050670

PCT Pub. Date: Apr. 23, 2009

(65) Prior Publication Data

US 2010/0245197 A1 Sep. 30, 2010

(30) Foreign Application Priority Data

Oct. 19, 2007 (EP) ..... 07118836

(51) Int. Cl.

| | |
|---|---|
| ***H01Q 13/10*** | (2006.01) |
| ***H01Q 1/38*** | (2006.01) |
| ***H01Q 5/00*** | (2006.01) |
| ***H01Q 13/08*** | (2006.01) |
| ***H01Q 21/30*** | (2006.01) |
| ***H01Q 1/24*** | (2006.01) |

(52) U.S. Cl.

CPC ..... *H01Q 13/085* (2013.01); *H01Q 5/0058* (2013.01); *H01Q 13/10* (2013.01); *H01Q 21/30* (2013.01); *H01Q 1/243* (2013.01); *H01Q 1/38* (2013.01)

USPC ..... 343/767; 343/700 MS

(58) Field of Classification Search

USPC ..... 343/767, 700 MS

See application file for complete search history.

(56) References Cited

U.S. PATENT DOCUMENTS

| | | | | |
|---|---|---|---|---|
| 6,346,914 | B1 * | 2/2002 | Annamaa | 343/700 MS |
| 6,822,611 | B1 * | 11/2004 | Kontogeorgakis et al. | 343/702 |
| 2003/0050032 | A1 * | 3/2003 | Masaki | 455/272 |
| 2003/0090426 | A1 | 5/2003 | Sun et al. | |
| 2005/0200545 | A1 | 9/2005 | Bancroft | |
| 2005/0200556 | A1 | 9/2005 | Lin et al. | |

FOREIGN PATENT DOCUMENTS

| | | | |
|---|---|---|---|
| WO | 2003/088418 | A1 | 10/2003 |
| WO | 2005/038981 | A | 4/2005 |
| WO | 2005/117205 | A1 | 12/2005 |
| WO | 2006/070017 | A1 | 7/2006 |

OTHER PUBLICATIONS

"Fano Bounds for Compact Antennas, Phase 1," JC Allen and J Meloling, Technical Report 1962, Oct. 2007, SSC San Diego, pp. i to 1.*

Su, Chih-Ming, et al; "Dual-Band Slot Antenna for 2.4/5.2 Ghz WLAN Operation"; Microwave and Optical Technology Letters, vol. 35, No. 4; pp. 306-308; (Nov. 20, 2002).

(Continued)

*Primary Examiner* — Graham Smith

(57) ABSTRACT

A dual-band antenna (100) for transmitting or receiving radio frequency signals in a lower and a higher frequency band, comprises a conductive plane (120), a slot (110) in the conductive plane (120), the slot (110) having first, second and third branches (103, 104, 105) emanating from a common point within the conductive plane (120). The first branch (103) has an end (113) open at an edge of the conductive plane (120) and the second and third branches (104, 105) each have a closed end (114, 115).

20 Claims, 5 Drawing Sheets

(56) References Cited

OTHER PUBLICATIONS

Liu, Duixian, et al; "A New Dual-Band Antenna for ISM Application"; Vehicular Technology Conference, 2000, Proceedings, VTC 2002-Fall, 2002 IEEE 56th; vol. 2; pp. 937-940 (2002).

Elsadek, Hala, et al; "Broad Band and Compact U-Shaped PIFA With Dual Band Capability for Bluetooth and WLAN Applications"; WSEAS Transactions on Communications, Issue 1, vol. 4; 6 pages; (Jan. 2005).

* cited by examiner

DUAL BAND SLOT ANTENNA

FIELD OF THE INVENTION

The invention relates to an antenna for transmitting or receiving radio signals, and to a radio communication device comprising the antenna. The invention has application in, particularly but not exclusively, wireless local area networks operating in frequency bands at about 2.5 GHz and about 5.5 GHz.

BACKGROUND TO THE INVENTION

A wide range of devices may be equipped for communication via a wireless local area network (WLAN), for example a PDA (personal digital assistant), an MP3 player, a biosensing device for heart-rate or blood pressure monitoring, an electronic newspaper, or devices for remote control applications. Such devices usually have a small form factor and therefore require an antenna that is compact.

Furthermore, such devices are commonly required to operate in more than one frequency band, for example at about 2.5 GHz and about 5.5 GHz, which places additional constraints on the antenna. An example of a technical standard for WLAN operation is IEEE802.11a/b/g, which is commonly referred to as WiFi.

WO2005/117205 A1 discloses a slot antenna comprising a conductive plane having a slot with an open end and a closed end and a connection point located near the slot more closely to the closed end than to the open end. The perimeter of the conductive plane is between 50% and 200% of the wavelength of operation. The antenna does not need to operate against a ground surface. Such an antenna is, however, suited to operation in only one frequency band.

Chih-Ming Su et al in "Dual-band Slot Antenna for 2.4/5.2 GHZ WLAN Operation", Microwave and Optical Technology Letters, vol. 35, no. 4, pp 306-308, 20 Nov. 2002, disclose an antenna suited to dual-band operation. The antenna comprises a copper plate placed in contact with one side edge of a ground plane, and has two narrow linear slots, a longer one for operation at 2.45 GHz aligned in parallel with a shorter one for operation at 5.25 GHz.

There remains a requirement for compact and efficient dual-band antennas.

SUMMARY OF THE INVENTION

According to a first aspect of the invention there is provided an antenna for transmitting or receiving radio frequency signals in a lower and a higher frequency band, the antenna comprising:

a conductive plane;

a slot in the conductive plane, the slot having first, second and third branches emanating from a common point within the conductive plane;

the first branch having an end open at an edge of the conductive plane; and the second and third branches each having a closed end.

By providing a slot having three branches, one branch being open at an edge of the conductive plane and the other two branches each having a closed end, the antenna can have two resonant frequencies, one provided by the first branch in combination with the third branch and one provided by the second branch in combination with the third branch. Such a slot configuration can enable operation in two frequency bands whilst also enabling the antenna to be compact.

Optionally, at least a portion of the second branch may be close coupled to at least a portion of the first branch. In particular, at least a portion of the second branch may be spaced apart from the first branch by about 5% or less of the shortest wavelength of the higher frequency band by a strip of the conductive plane. In this example, only one feed point needs to be used for the two frequency bands.

Optionally, the perimeter of the conductive plane, excluding the perimeter of the slot, may be substantially equal to or exceed the longest wavelength of the lower frequency band. This enables the antenna to have a high efficiency.

Optionally, at least a portion of the second or third branch may be co-linear with at least a portion of the first branch. Optionally, at least one of the first branch, the second branch and the third branch may be non-linear. These features provide flexibility in the layout of the slot to enable the branches to be positioned conveniently with respect to associated circuitry.

Optionally, the sum of the length of the first branch and the length of the third branch may be within about ±20% of a quarter of a wavelength of the centre frequency of the lower frequency band. This enables the antenna to be efficient at frequencies in the lower frequency band. Because the first branch has an end open at an edge of the conductive plane, resonance will occur at frequencies for which this combination of branches is in the region of a quarter of a wavelength, which enables the antenna to be compact. Preferably, the sum of the length of the first branch and the length of the third branch may be within the range about 13 mm to about 20 mm, which is suitable for a centre frequency of the lower frequency band of about 2.5 GHz.

Optionally, the sum of the length of the second branch and the length of the third branch may be within about ±20% of a half of a wavelength of the centre frequency of the higher frequency band. This enables the antenna to be efficient at frequencies in the higher frequency band. Because the second and third branches have closed ends, resonance will occur at frequencies for which this combination of branches is in the region of a half of a wavelength, which enables the antenna to be compact. Preferably, the sum of the length of the second branch and the length of the third branch may be within the range about 17 mm to about 27 mm, which is suitable for a centre frequency of the higher frequency band of about 5.5 GHz.

Optionally, the width of the slot may be about 5% or less of the shortest wavelength of the higher frequency band. This enables the antenna to be efficient whilst using only a small area of the conductive plane for the slot.

Optionally, the end of the first branch open at an edge of the conductive plane is located between about 30% and about 70% of the distance along that edge between two corners of the conductive plane. This enables the antenna to have a wide bandwidth in both the lower frequency band and the higher frequency band.

Optionally, the conductive plane is part of a circuit board for mounting components of an electronic circuit. This enables a compact product, with a circuit board serving the dual purpose of supporting both the antenna and electronic circuitry.

The invention also provides a radio communication device comprising the antenna according to the first aspect of the invention.

Optionally, the radio communication device may comprise a common feed point for coupling radio frequency signals in the lower and the higher frequency band into or out of the antenna. This avoids the need for separate feed points for two frequency bands and enables a compact design.

BRIEF DESCRIPTION OF DRAWINGS

The invention will now be described, by way of example only, with reference to the accompanying drawings, in which.

DETAILED DESCRIPTION OF PREFERRED EMBODIMENTS

Figure 1:
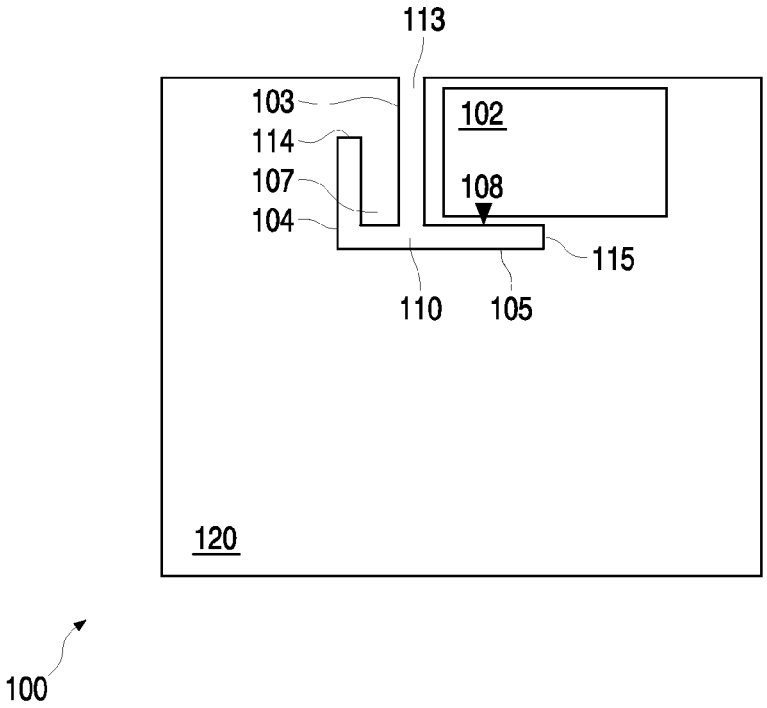
FIG. 1 is plan view of a preferred embodiment of an antenna.

Referring to FIG. 1, there is illustrated a dual-band antenna 100 having a conductive plane 120 and a slot 110 formed in the conductive plane 120. The slot 110 has a first branch 103, a second branch 104, and a third branch 105. The first branch 103 has an end 113 open at an edge of the conductive plane 120 and its other end is open to the second and third branches 104, 105. The first branch 103 is perpendicular to an edge of the conductive plane 120. The second branch 104, in addition to having an end open to the other branches 103, 105, has a closed end 114. Similarly, the third branch 105, in addition to having an end open to the other branches 103, 104, has a closed end 115.

A portion of the second branch 104 is parallel with the first branch 103. The remainder of the second branch 104 is co-linear with the third branch 105. The third branch 105 is perpendicular to the first branch 103 and to the portion of the second branch 104 that is parallel to the first branch 103.

The conductive plane 120 may be formed on a circuit board for mounting components of an electronic circuit, with interconnecting tracks and insulating spaces formed in the conductive plane 120. In this case the antenna 100 may comprise electronic components 102 mounted on the conductive plane and the interconnecting tracks may be formed around and beneath the electronic components 102. The conductive plane 120 may be a copper layer of a printed circuit board that consists of a laminate, such as the commonly used material FR4. The conductive plane need not necessarily be flat and may be flexible, for example a flexible layer on a flexible circuit board or other substrate.

The open end 113 of the first branch 103 is located centrally on, or close to the centre of, one edge of the conductive plane 120. This is to maximise the bandwidth of the antenna 100. Operation is feasible with the open end 113 further from the central position, and even close to a corner of the conductive plane 120, but with reduced frequency operating range, as the bandwidth over which the impedance is acceptable is reduced. It is desirable to have some spare useable bandwidth to cope with detuning of the antenna 100 when a device incorporating the antenna 100 is handheld or is used near a user's body. If there is spare bandwidth available, the antenna 100 can remain efficient despite being affected by the hand or user's body. Preferably the open end 113 of the first branch 103 is between about 30% and about 70% of the distance along the edge between two corners of the conductive plane 120.

The length of the first branch 103 and the third branch 105 are mainly determined by the lowest desired operating frequency band. The sum of the length of the first branch 103 and the third branch 105 is in the region of a quarter wavelength of the centre frequency of the lower frequency band. Preferably that length is within about ±20% of a quarter of a wavelength of the centre frequency of the lower frequency band, although allowance may need to be made for the material on which the conductive plane 120 is mounted. For example, if the conductive plane 120 is mounted on FR4 material, a suitable length is in the range about 13 mm to about 20 mm for a centre frequency of about 2.5 GHz, although other lengths may be used, possibly with reduced antenna efficiency. For the higher frequency band, the second branch 104 and third branch 105 together form a slot closed at each end, their combined length being approximately half a wavelength of the centre frequency of the higher frequency band. So the third branch 105 is used for both frequency bands. Preferably the combined length of the second branch 104 and the third branch 105 is within about ±20% of a half wavelength of the centre frequency of the higher frequency band, although again allowance may need to be made for the material on which the conductive plane 120 is mounted. For example, if the conductive plane 120 is mounted on FR4 material, a suitable length is in the range about 17 mm to about 27 mm for a centre frequency of about 5.5 GHz, although other lengths may be used, possibly with reduced antenna efficiency. The choice of lengths may also be influenced by the width of the slot 110. Suitable values of all the dimensions may be determined by 3-dimensional simulation of the antenna 100.

A feed point 108 position for the antenna 100 is on the third branch 105 and at a distance from the closed end 115, as indicated by an arrow head in FIG. 1. This distance determines the absolute value of the input impedance. The closer the feed point 108 is to the closed end 115, the lower the input impedance is, and the further from the closed end 115, the higher the input impedance. Preferably the feed point 108 is chosen for 50 ohms input impedance, and the optimum position can be found by means of 3-dimensional electro magnetic simulation using commercially available simulation tools.

The antenna 100 of FIG. 1 has a single feed point 108 for both operating frequency bands. A single feed point 108 can enable a compact design because it is desirable for the circuit components to be close to the feed point 108 and to the third branch 105, and it enables dual-band WiFi modules or integrated circuits to have only one feed point.

The portion of the second branch 104 that is parallel with the first branch 103 is spaced apart from the first branch 103 by a strip 107 of the conductive plane. The strip 107 provides close coupling of the first branch 103 and the second branch 104. The close coupling of the first branch 103 and the second branch 104 enables a low impedance match for the higher and lower frequency bands whilst using the same feed point 108 for the higher and lower frequency bands. Thus this feature also enables a compact design and makes a large area of the conductive plane available for electronic components 102. Preferably at least a portion of the second branch 104 is spaced apart from the first branch 103 by about 5% or less of the shortest wavelength of the higher frequency band by the strip 107 of the conductive plane 120. For example, a suitable width of the strip 107 is about 1 mm for operation up to about 6 GHz.

The width of the slot 110 can be very small compared with the wavelength of the operating frequency, for example about 0.5 mm to about 2 mm, with about 1 mm as a suggested value for operation between about 2.4 GHz for which the wavelength is about 125 mm and about 6 GHz for which the wavelength is about 50 mm. Preferably the width of the slot 110 is about 5% or less of the shortest wavelength of the higher frequency band.

The perimeter of the conductive plane 120, excluding the perimeter of the slot 110, is preferably at least about one wavelength of the lowest operating frequency. Therefore for operation at 2.4 GHz and above, the perimeter is preferably at least about 125 mm. Suggested dimensions are about 40 mm by about 40 mm, providing a perimeter of 160 mm.

Figure 8:
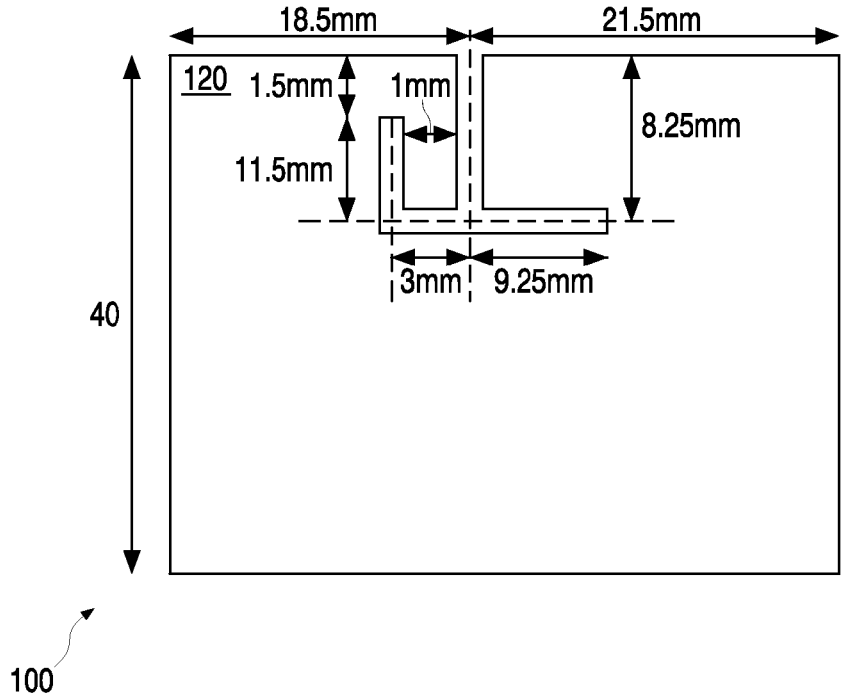
FIG. 8 indicates suitable dimensions for the antenna of FIG. 1.

Suitable dimensions for the conductive plane 120, slot 110 and the branches 103, 104, 105 of the antenna 100 of FIG. 1 are indicated in millimeters in FIG. 8 for operating in a lower frequency band ranging from about 2.4 GHz to about 2.5 GHz and a higher frequency band ranging from about 5 GHz to about 6 GHz. Reference numerals associated with the branches have been omitted from FIG. 8 for clarity, but can readily be identified from FIG. 1. Thus the first branch 103 is 8.25 mm long, the second branch 104 is 11.5 mm plus 3 mm, i.e. 14.5 mm, long, and the third branch 105 is 9.25 mm long. The feed point 108 is 5 mm from the closed end 115 of the third branch 105. The conductive plane 120 may be a copper layer on one side of a printed circuit board made of FR4 material having a thickness 1.6 mm, and with the copper removed to form the slot 110.

In the embodiment illustrated in FIG. 1, the first branch 103 and the third branch 105 are linear, i.e. straight. However, any of the first, second and third branches 103, 104, 105 may be linear or non-linear. Additionally, at least a portion of at least one of the second branch 104 and the third branch 105 may be co-linear with at least a portion of the first branch 103. Some of these options are illustrated in the embodiment of FIG. 2.

Figure 2:
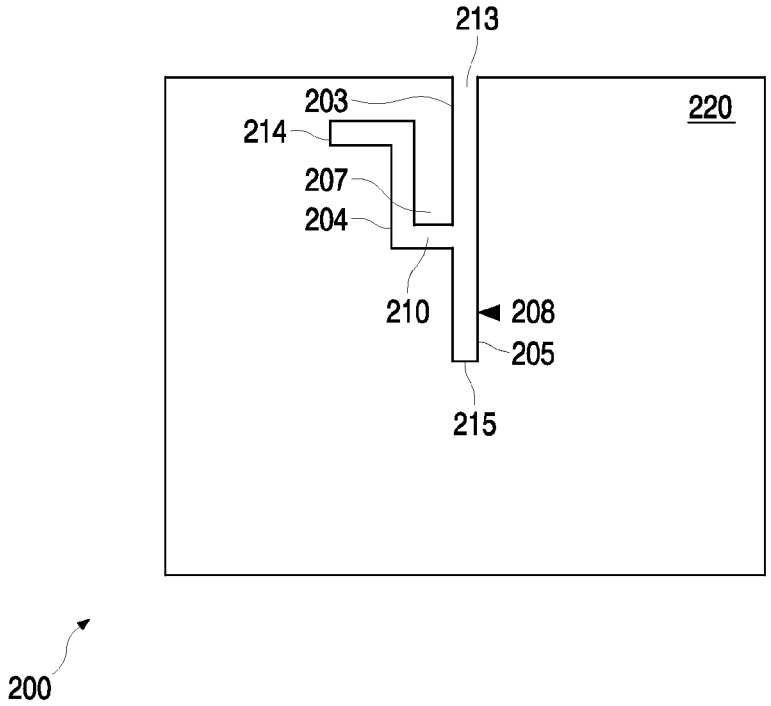
FIG. 2 is a plan view of another preferred embodiment of an antenna.

Referring to FIG. 2, there is illustrated an antenna 200 having a conductive plane 220 and a slot 210 formed in the conductive plane 220. The slot 210 has a first branch 203, a second branch 204, and a third branch 205. The first branch 203 has a first end 213 open at an edge of the conductive plane 220 and its other end is open to the second and third branches 204, 205. The second branch 204, in addition to having an end open to the other branches 203, 205, has a closed end 214. Similarly, the third branch 205, in addition to having an end open to the other branches 203, 204, has a closed end 215.

The second branch 204 has a portion parallel with the first branch 203 and portions perpendicular to, or at least not parallel with, the first branch 203. The non-linear form of the second branch 204 is a convenient way of accommodating a second branch 204 that cannot be accommodated in a linear form due to the length of the first branch 203 or the dimensions of the conductive plane 220. The parallel portion of the second branch 204 is close coupled to the first branch 203 by a strip 207 of the conductive plane. This parallel portion is sufficiently long to provide a low input impedance at the single feed point 208 indicated by an arrow head in FIG. 2. The third branch 205 is parallel to, and in line with, i.e. co-linear with, the first branch 203.

The perimeter of the conductive plane 220, excluding the perimeter of the slot 210, conforms to the same characteristics as described above for the antenna of FIG. 1. The dimensions indicated in FIG. 8 for the length of the branches 103, 104, 105, the width of the strip 107, the position of the open end 113 and the dimensions of the conductive plane 120 are applicable to the antenna of FIG. 2, except that the 11.5 mm portion of the second branch 204 is formed of two portions as described above. The slot configuration of FIG. 2 provides a larger rectangular area for placing electronic components close to the feed point 208 on the third branch 205, although such components are not illustrated in FIG. 2.

The performance of the antennas 100, 200 illustrated in FIGS. 1 and 2 has been assessed by 3-dimensional computer simulation. The simulation was performed for a copper layer of 0.035 mm thickness as the conductive plane 120, 220 on a 1.6 mm thick FR4 printed circuit board with dimensions of 40 by 40 mm. Such an antenna 100, 200 is of sufficient size to accommodate wireless speaker circuitry that can be incorporated in a PDA or other small electronic device. Radio frequency circuitry, which may be screened with additional conducting material, may be on the printed board as well as other electronics. The area of the slot 110, 210 is below 45 $mm^2$.

Figure 3:
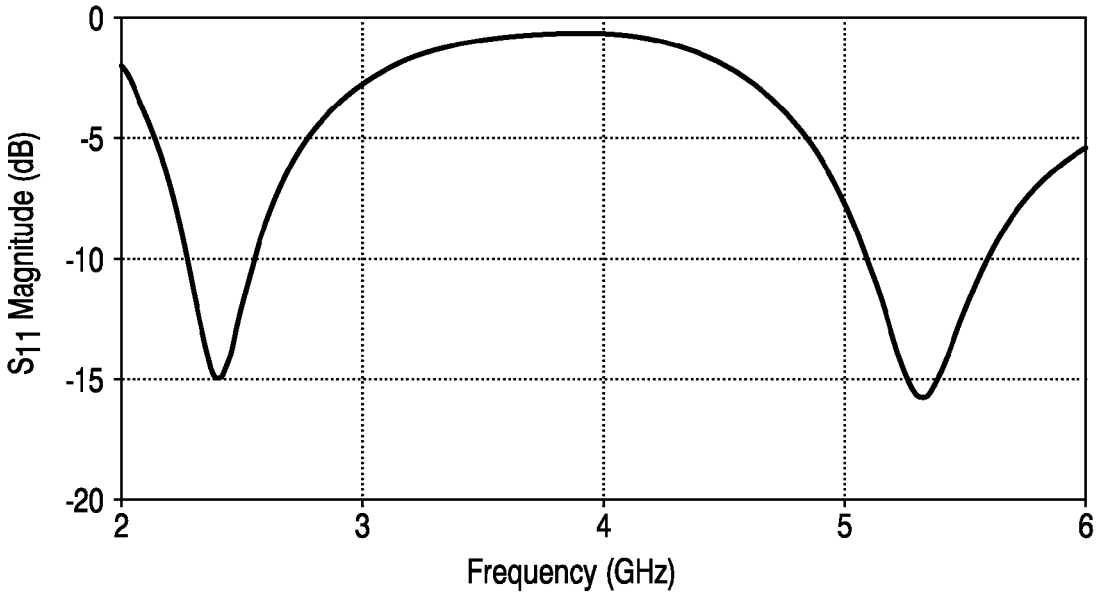
FIG. 3 is a graph of simulated return loss for the antenna of FIG. 1.

The simulated return loss of the antenna 100 of FIG. 1 is shown in FIG. 3, presented as a graph of the magnitude of S-parameter $S_{11}$ as a function of frequency. These are results without any impedance matching network. With an impedance matching network the return loss can be improved, for example by including a series capacitor. As can be seen, the antenna 100 is operable at both the 2.5 GHz and 5.5 GHz WiFi frequency bands.

Figure 4:
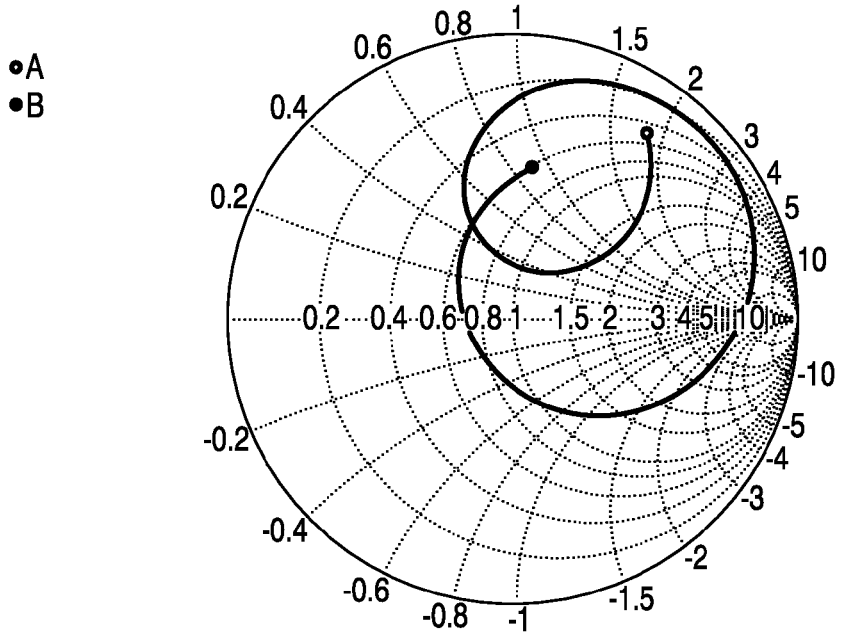
FIG. 4 is a Smith Chart illustrating the simulated input impedance of the antenna of FIG. 1.

FIG. 4 shows the simulated input impedance of the antenna 100 of FIG. 1 terminated by 50Ω, presented as a Smith Chart, which shows an impedance of 25.39+j91.94Ω at 2 GHz (point A) and an impedance of 31.13+j45.97Ω at 6 GHz (point B). The matching to, for example, a 50Ω source impedance of a radio transceiver input and output, can be improved with a matching network.

Figure 5:
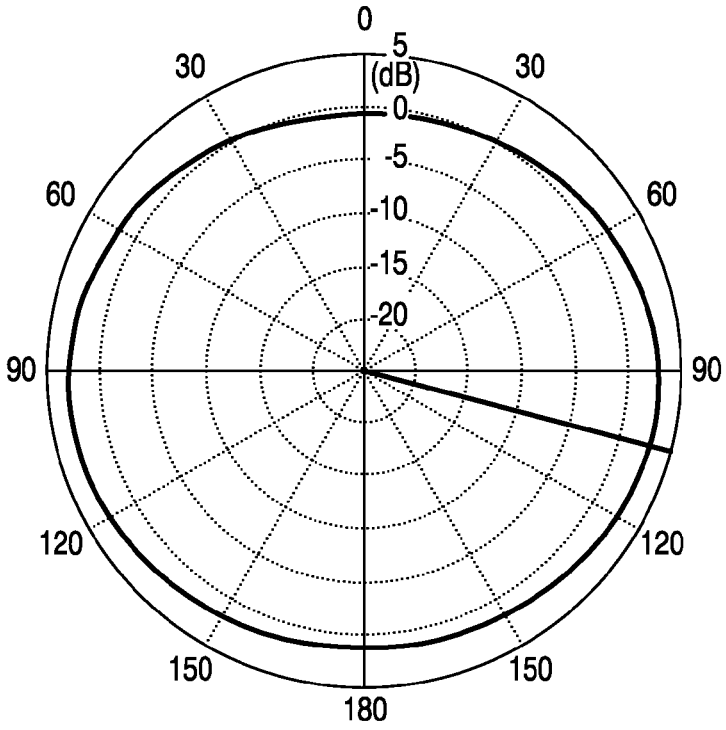
FIG. 5 is the simulated 2-dimensional radiation pattern at 2.5 GHz of the antenna of FIG. 1.
Figure 6:
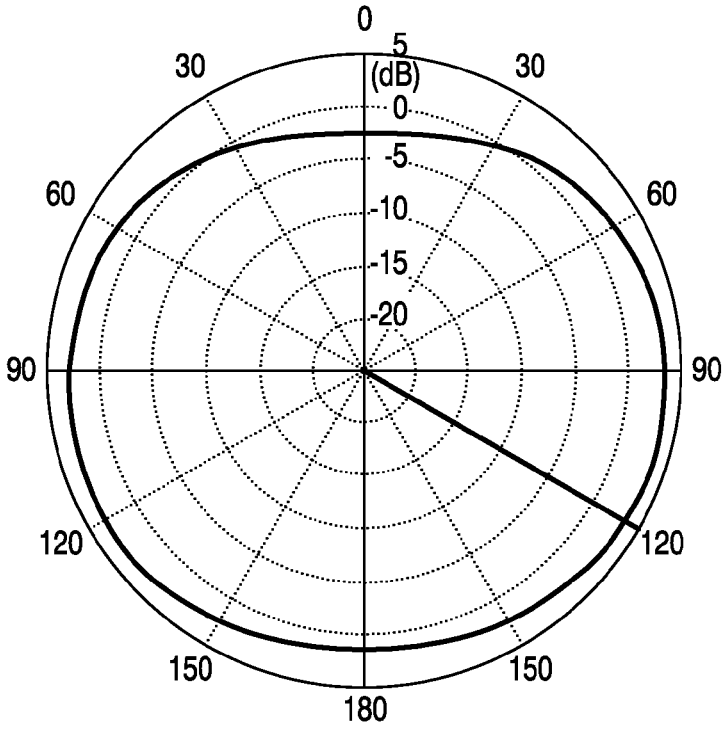
FIG. 6 the simulated 2-dimensional radiation pattern at 5.5 GHz of the antenna of FIG. 1.

FIGS. 5 and 6 show a 2-dimensional view of a simulated 3-dimensional radiation pattern for both frequency bands for the antenna 100 of FIG. 1, for a plane perpendicular to the conductive plane 120 and parallel with the first branch 130, which indicates that the antenna gain is 2.2 dBi at 2.5 GHz and 3.1 dBi at 5.5 GHz, and that the radiation patterns are quite omnidirectional.

Figure 7:
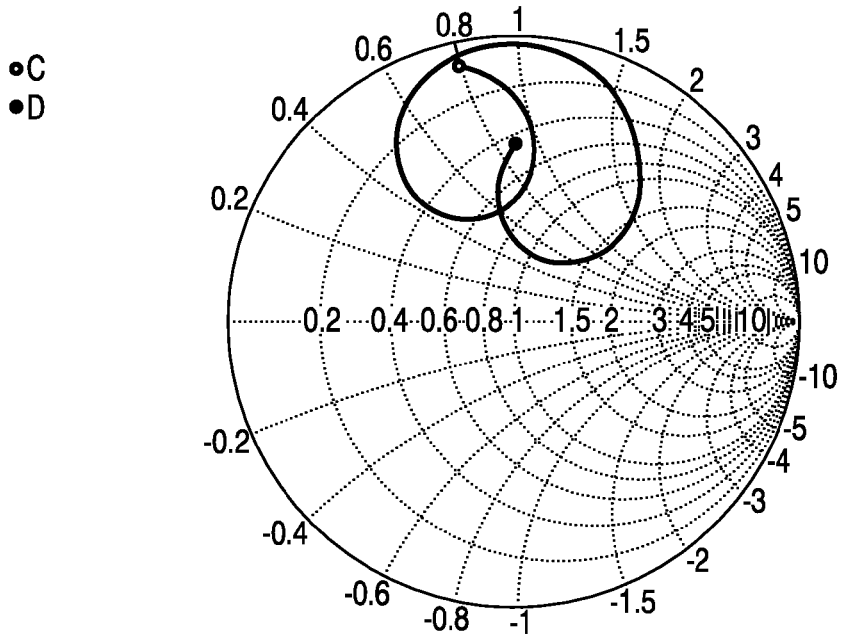
FIG. 7 is a Smith Chart illustrating the simulated input impedance of the antenna of FIG. 2.

FIG. 7 shows the simulated antenna impedance for the antenna 200 of FIG. 2 terminated by 50Ω, without any impedance matching, presented as a Smith Chart, which shows an impedance of 3.74+j40.14Ω at 2 GHz (point C) and an impedance of 22.3+j45.06Ω at 6 GHz (point D). Again, the return loss can be improved with an impedance matching circuit, for example a series capacitor.

Although the illustrated embodiments of the invention employ a square or rectangular conductive plane 120, 220, this is not an essential requirement and the conductive plane 120, 220 may have any convenient shape.

Although the illustrated embodiments of the invention employ a slot 110, 210 having a constant width, this is not an essential requirement and the width of the slots 110, 210 may vary.

Although the illustrated embodiments of the invention employ a straight (i.e. linear) first branch 103, 203, and second branch 104, 204, either or both of these branches may not be straight (e.g. not linear).

Figure 9:
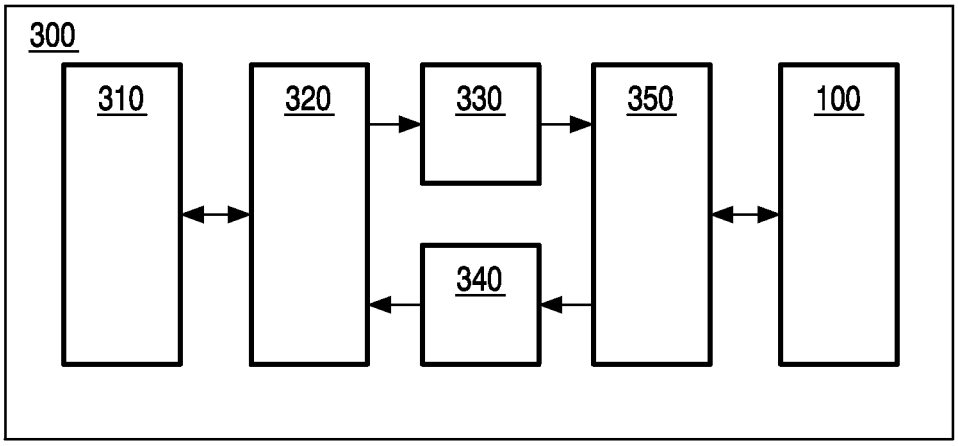
FIG. 9 is a block schematic diagram of a radio communication device comprising the antenna of FIG. 1 or 2.

FIG. 9 is a block schematic diagram of a radio communication device 300 which may be, for example, a home theatre controller, a surround sound controller, a wireless headphone interface, a second room wireless audio interface, a bio-sensing device, a position tracking device, a mobile terminal or a wireless interface. The radio communication device 300 comprises a man-machine interface 310 coupled to a digital signal processor 320. The digital signal processor 320 is coupled via a digital-to-analogue converter (DAC) 330 and an analogue-to-digital converter (ADC) 340 to a radio transceiver 350. The radio transceiver 350 is coupled to an antenna 100 in accordance with the invention. The circuit components of the radio transceiver 350 may be partially or completely mounted on a printed circuit board of which the conductive plane 120 is part.

Such a radio communication device 300 can advantageously operate in two different frequency bands. One application of such dual-band operation provides greater flexibility and better performance, as follows. A lower frequency band is generally more power efficient than a higher frequency band. Consequently, the lower frequency band generally allows data communication over a greater distance. However, as a result, there is a greater risk of interference due to other data communications in the lower frequency band. Furthermore, the lower frequency band may comprise fewer channels than the higher frequency band, which contributes to this risk. It is therefore desirable that the radio communication device 300 can be made to operate in the lower or higher frequency band depending on a particular context, and consequently employ a dual-band antenna in accordance with the invention.

Although embodiments of the invention has been described which are suitable for operation in the WiFi frequency bands of about 2.4 GHz to about 2.5 GHz and about 5 GHz to about 6 GHz, the invention can be applied in other frequency bands and for other applications, for example at any frequency up to say about 10 GHz Although embodiments of the invention have been described in which the slot 110, 210 has three branches 103, 104, 105 and is suitable for dual-band operation, the use of additional branches and operation with more than two frequency bands is not precluded.

The term "about" has been used throughout, including in the claims, to specify that a given value need not be exact. In other words, values that are not significantly different from the given value to which the term "about" is applied may be equivalent to it.

From reading the present disclosure, other variations and modifications will be apparent to the skilled person. Such variations and modifications may involve equivalent and other features which are already known in the art of antenna design, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, and reference signs in the claims shall not be construed as limiting the scope of the claims.

The invention claimed is:

1. A dual-band antenna for transmitting or receiving radio frequency signals in a lower frequency and a higher frequency, the antenna comprising:

a conductive plane;

a slot in the conductive plane, the slot having first, second and third branches emanating from a common point within the conductive plane;

the first branch having an end open at an edge of the conductive plane; and the second and third branches each having a closed end, wherein the perimeter of the conductive plane, excluding the perimeter of the slot, is equal to or exceeds the wavelength of the lower frequency, wherein a portion of the second branch is in parallel with the first branch, wherein the remainder of the second branch is perpendicular to the first branch and to the portion of the second branch that is in parallel with the first branch, and wherein relative lengths of the first, second and third branches are 8.25, 14.5 and 9.25.

2. The antenna of claim 1, wherein at least a portion of the second branch is close coupled to at least a portion of the first branch.

3. The antenna of claim 1, wherein at least a portion of the second branch is spaced apart from the first branch by 5% or less of the wavelength of the higher frequency by a strip of the conductive plane.

4. The antenna of claim 1, wherein at least a portion of at least one of the second branch and third branch is co-linear with at least a portion of the first branch.

5. The antenna of claim 1, wherein at least one of the first branch, the second branch and the third branch is non-linear.

6. The antenna of claim 1, wherein the sum of the length of the first branch and the length of the third branch is within about ±20% of a quarter of the wavelength of the lower frequency.

7. The antenna of claim 1, wherein the sum of the length of the second branch and the length of the third branch is within about ±20% of a half of the wavelength of the higher frequency.

8. The antenna of claim 1, wherein the sum of the length of the first branch and the length of the third branch is within the range 13 mm to about 20 mm.

9. The antenna of claim 1, wherein the sum of the length of the second branch and the length of the third branch is within the range 17 mm to about 27 mm.

10. The antenna of claim 1, wherein the width of the slot is 5% or less of the wavelength of the higher frequency.

11. The antenna of claim 1, wherein the end of the first branch open at an edge of the conductive plane is located between 30% and 70% of the distance along that edge between two corners of the conductive plane.

12. The antenna of claim 1, wherein the conductive plane is part of a circuit board for mounting components of an electronic circuit.

13. A radio communication device comprising the antenna as claimed in claim 1.

14. A radio communication device as claimed in claim 11, comprising a common feed point for coupling radio frequency signals in the lower frequency and the higher frequency into or out of the antenna.

15. The dual-band antenna of claim 1, wherein a ratio of the distance between the portion of the second branch and an edge of the conductive plane versus the distance between the portion of the second branch and the first branch is equal to 1.5.

16. A dual-band antenna for transmitting or receiving radio frequency signals in a lower frequency and a higher frequency, the antenna comprising:

a conductive plane;

a slot in the conductive plane, the slot having first, second and third branches emanating from a common point within the conductive plane;

the first branch having an end open at an edge of the conductive plane; and the second and third branches each having a closed end, wherein the perimeter of the conductive plane, excluding the perimeter of the slot, is equal to or exceeds the wavelength of the lower frequency, wherein a portion of the second branch is in parallel with the first branch, wherein the remainder of the second branch is perpendicular to the first branch and to the portion of the second branch that is in parallel with the first branch, and wherein a ratio of the distance between the portion of the second branch and an edge of the conductive plane versus the distance between the portion of the second branch and the first branch is equal to 1.5.

17. The antenna of claim 16, wherein at least a portion of the second branch is close coupled to at least a portion of the first branch.

18. The antenna of claim 16, wherein at least a portion of the second branch is spaced apart from the first branch by 5% or less of the wavelength of the higher frequency by a strip of the conductive plane.

19. A radio communication device comprising the antenna as claimed in claim 16.

20. A radio communication device as claimed in claim 19, comprising a common feed point for coupling radio frequency signals in the lower frequency and the higher frequency into or out of the antenna.

* * * * *